US008052544B2

(12) United States Patent
Tien

(10) Patent No.: US 8,052,544 B2
(45) Date of Patent: Nov. 8, 2011

(54) BASKETBALL PRACTICING APPARATUS

(76) Inventor: Feng-Yi Tien, Chiayi (TW)

( * ) Notice: Subject to any disclaimer, the term of this patent is extended or adjusted under 35 U.S.C. 154(b) by 244 days.

(21) Appl. No.: 12/612,840

(22) Filed: Nov. 5, 2009

(65) Prior Publication Data

US 2011/0105250 A1 May 5, 2011

(51) Int. Cl.
*A63B 69/00* (2006.01)

(52) U.S. Cl. ..... 473/433

(58) Field of Classification Search ..... 473/433, 473/482, 481, 432, 431, 422; 74/411; 73/1.12; 404/6; 273/368; 335/262; 40/479, 480; 292/341.16, 144; 414/250
See application file for complete search history.

(56) References Cited

U.S. PATENT DOCUMENTS 3,662,979 A * 5/1972 Lucci ..... 248/553
4,202,543 A * 5/1980 Collins ..... 273/359
4,268,029 A * 5/1981 Collins ..... 273/359
5,035,423 A * 7/1991 Arciniega ..... 473/433
5,074,552 A * 12/1991 Gomez et al. ..... 473/433
5,165,680 A * 11/1992 Cass ..... 473/433
5,171,009 A * 12/1992 Filewich et al. ..... 473/433
5,330,175 A * 7/1994 Kim ..... 273/397
5,364,091 A * 11/1994 Sebek ..... 473/433
6,536,770 B1 * 3/2003 Yang ..... 273/317.3
6,918,591 B2 * 7/2005 D'Amico et al. ..... 273/317.3
2008/0261726 A1 * 10/2008 Chipperfield ..... 473/434

* cited by examiner

*Primary Examiner* — Gene Kim
*Assistant Examiner* — M Chambers
(74) *Attorney, Agent, or Firm* — Alan Kamrath; Kamrath & Associates PA

(57) ABSTRACT

A basketball practicing apparatus includes a frame, a support bracket mounted in the frame, a drive shaft rotatably mounted on the support bracket, a backboard mounted on the drive shaft to rotate in concert with the drive shaft, and a basket ring mounted on the backboard to move in concert with the backboard. Thus, the backboard and the basket ring are rotated about the drive shaft so that the position and angle of the backboard and the basket ring can be changed arbitrarily and freely to facilitate a user practicing throwing the basketballs in different angles.

14 Claims, 5 Drawing Sheets

BASKETBALL PRACTICING APPARATUS

BACKGROUND OF THE INVENTION

1. Field of the Invention

The present invention relates to a practicing apparatus and, more particularly, to a basketball practicing apparatus.

2. Description of the Related Art

A conventional basketball practicing apparatus comprises a frame, a backboard mounted in the frame, a basket ring mounted on the backboard, and a return table mounted in the frame and located under the basket ring to return basketballs falling from the basket ring. Thus, a user can throw basketballs into the basket ring to practice the basketball skills. However, the position and angle of the backboard and the basket ring are fixed and cannot be adjusted, thereby easily causing a tedious sensation to the user during a long-term utilization.

BRIEF SUMMARY OF THE INVENTION

In accordance with the present invention, there is provided a basketball practicing apparatus, comprising a frame, a support bracket mounted in the frame, a drive shaft rotatably mounted on the support bracket, a backboard mounted on the drive shaft to rotate in concert with the drive shaft, and a basket ring mounted on the backboard to move in concert with the backboard. The basketball practicing apparatus further comprises a positioning bar mounted on the backboard to move in concert with the backboard and a fixing member movably mounted on the support bracket and movable to press the positioning bar so as to position the positioning bar. The basketball practicing apparatus further comprises an actuating unit mounted on the support bracket and connected with the fixing member to drive the fixing member to move relative to the positioning bar. The basketball practicing apparatus further comprises a reinforcement rib mounted on the backboard to reinforce a strength of the backboard. The basketball practicing apparatus further comprises a drive unit connected with the drive shaft to rotate the drive shaft.

The primary objective of the present invention is to provide a basketball practicing apparatus whose backboard and basket ring can be rotated.

According to the primary objective of the present invention, the backboard and the basket ring are rotated about the drive shaft so that the position and angle of the backboard and the basket ring can be changed arbitrarily and freely to facilitate a user practicing throwing the basketballs in different angles.

According to another objective of the present invention, the backboard and the basket ring are positioned solidly and stably by the fixing member to prevent the backboard and the basket ring from being deflected due to a violent hitting force applied by the basketballs.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
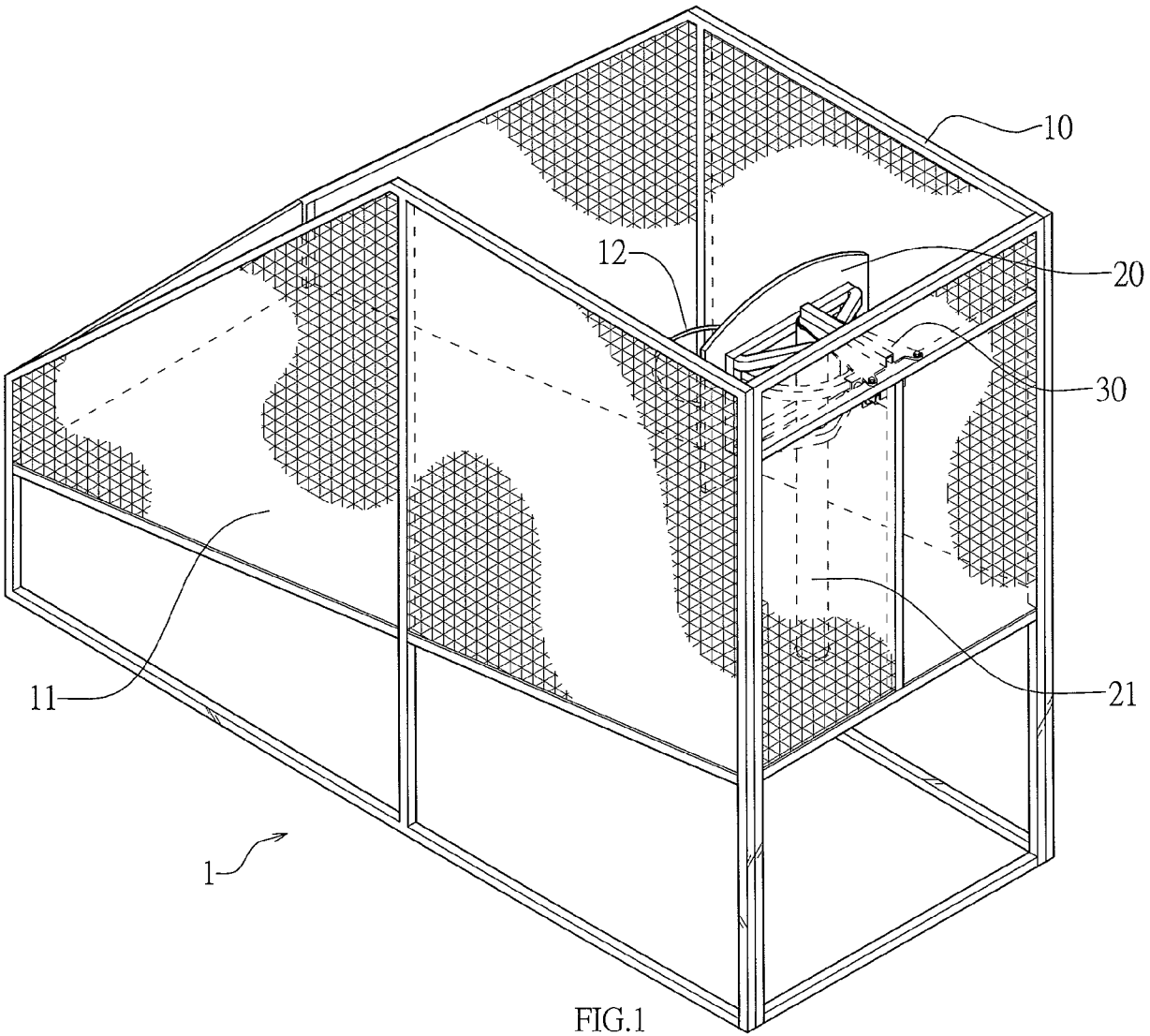
FIG. 1 is a perspective view of a basketball practicing apparatus in accordance with the preferred embodiment of the present invention.
Figure 2:
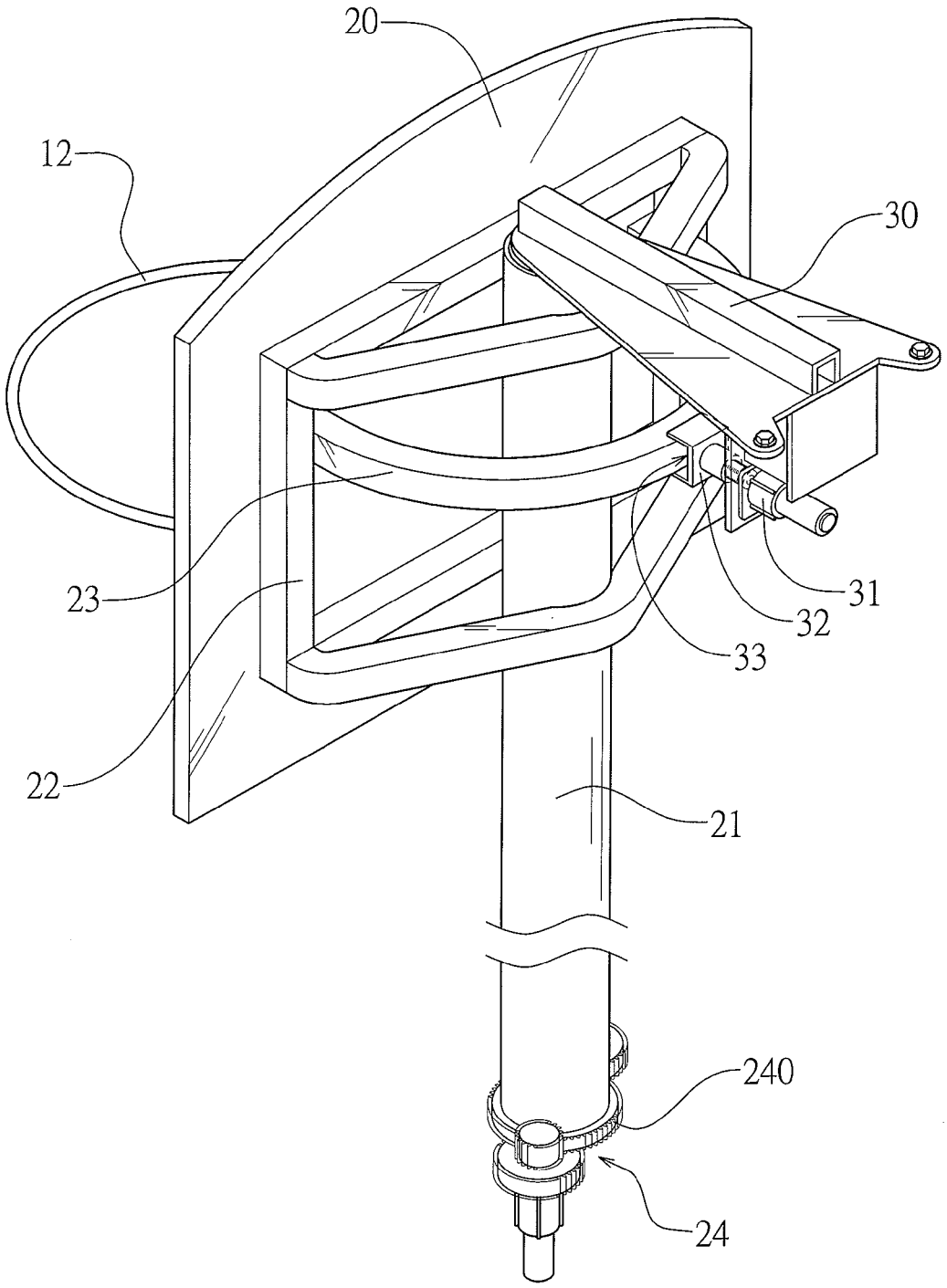
FIG. 2 is a partially enlarged perspective view of the basketball practicing apparatus as shown in FIG. 1.
Figure 3:
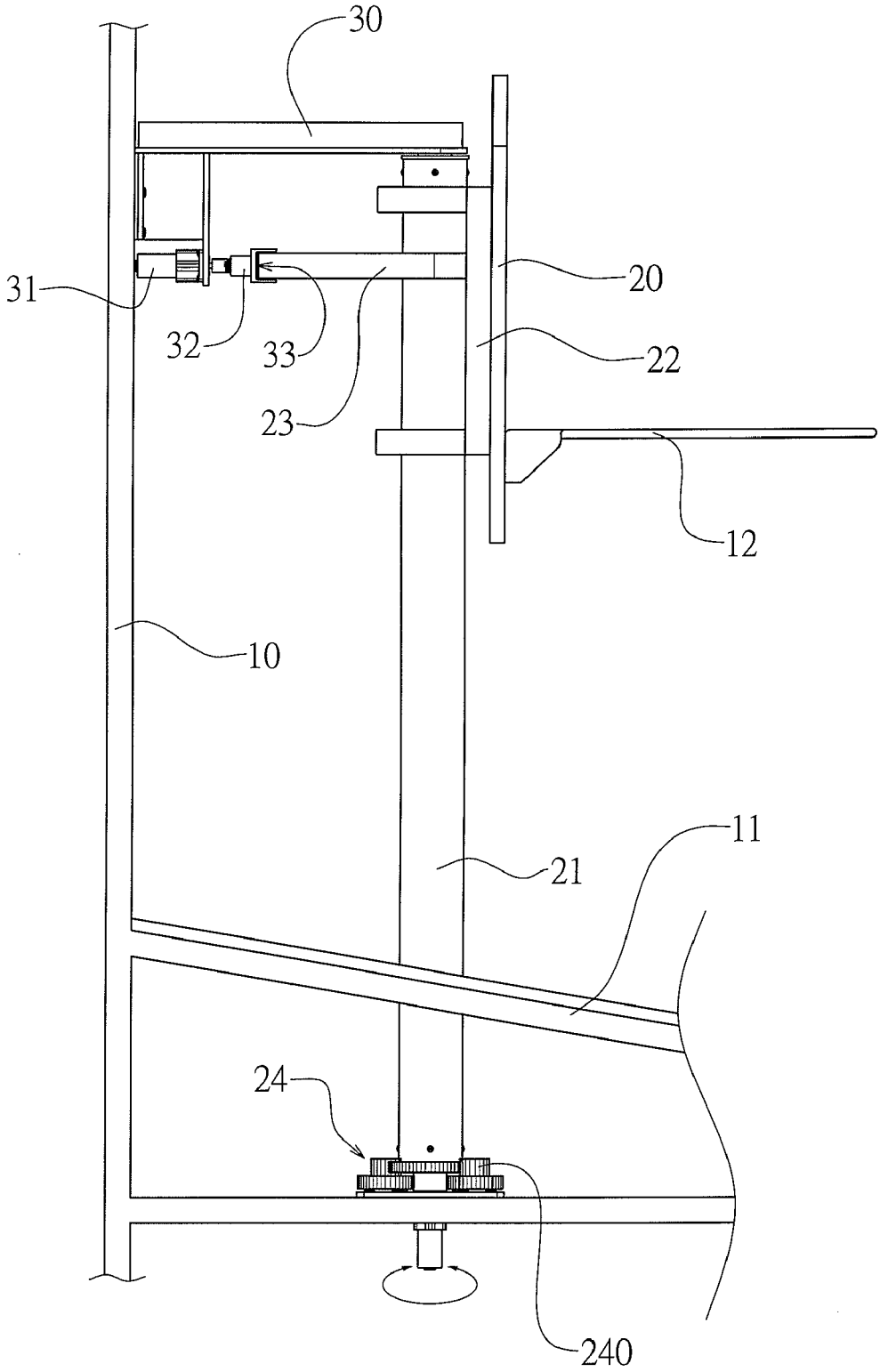
FIG. 3 is a partially enlarged side view of the basketball practicing apparatus as shown in FIG. 1.

Referring to the drawings and initially to FIGS. 1-3, a basketball practicing apparatus 1 in accordance with the preferred embodiment of the present invention comprises a frame 10, a support bracket 30 mounted in the frame 10, a drive shaft 21 rotatably mounted on the support bracket 30, a drive unit 24 connected with the drive shaft 21 to rotate the drive shaft 21, a backboard 20 mounted on the drive shaft 21 to rotate in concert with the drive shaft 21, a basket ring 12 mounted on the backboard 20 to move in concert with the backboard 20, a return table 11 mounted in the frame 10 and located under the basket ring 12 to return basketballs falling from the basket ring 12, a reinforcement rib 22 mounted on the backboard 20 to reinforce a strength of the backboard 20, a positioning bar 23 mounted on the backboard 20 to move in concert with the backboard 20, a fixing member 32 movably mounted on the support bracket 30 and movable to press the positioning bar 23 so as to position the positioning bar 23, and an actuating unit 31 mounted on the support bracket 30 and connected with the fixing member 32 to drive the fixing member 32 to move relative to the positioning bar 23.

The drive shaft 21 is disposed at an upright state. The drive shaft 21 has an upper end rotatably mounted on the support bracket 30 and a lower end connected with the drive unit 24. The drive shaft 21 functions as a fulcrum of rotation of the backboard 20 and the basket ring 12. The drive unit 24 includes a plurality of gears 240 intermeshing with each other. The reinforcement rib 22 is located between the backboard 20 and the drive shaft 21. The positioning bar 23 has a substantially arc-shaped profile. The fixing member 32 has a substantially U-shaped profile and has an opening 33 that is movable to receive the positioning bar 23. The opening 33 of the fixing member 32 is directed toward the positioning bar 23. The backboard 20 is located between the basket ring 12 and the drive shaft 21.

Figure 4:
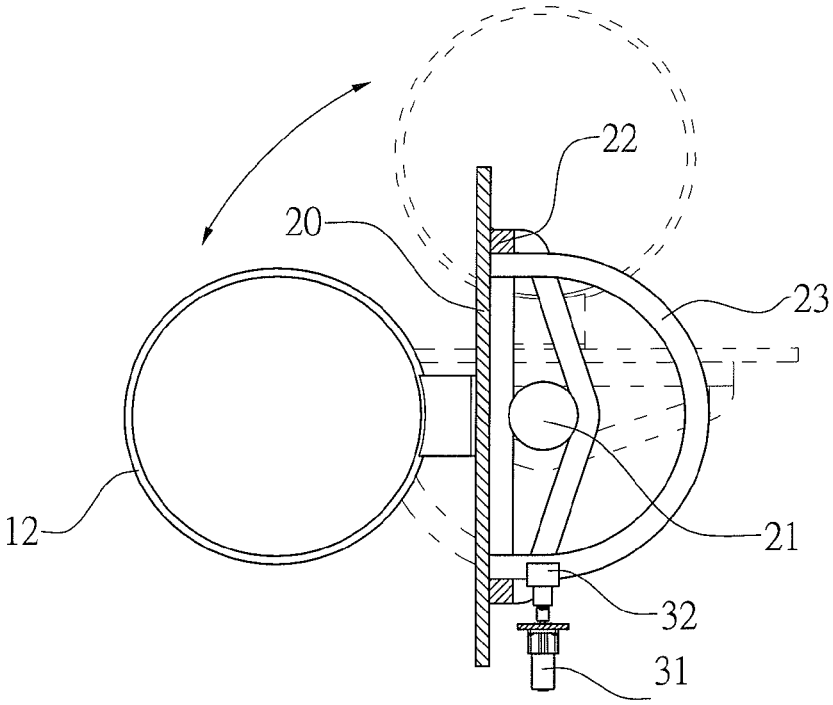
FIG. 4 is a partially enlarged top cross-sectional operational view of the basketball practicing apparatus as shown in FIG. 1.
Figure 5:
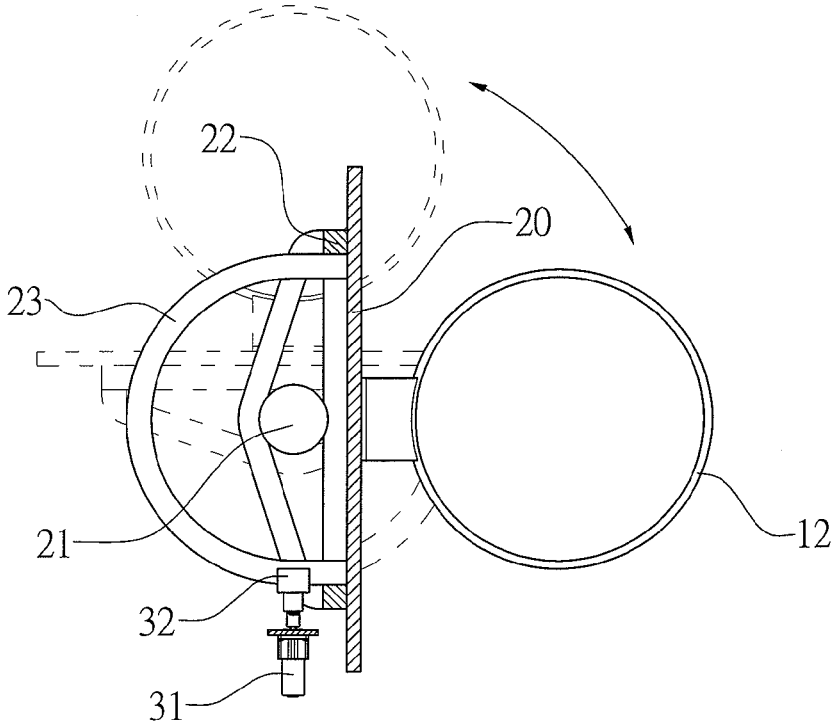
FIG. 5 is a partially enlarged top cross-sectional operational view of the basketball practicing apparatus as shown in FIG. 1.
Figure 6:
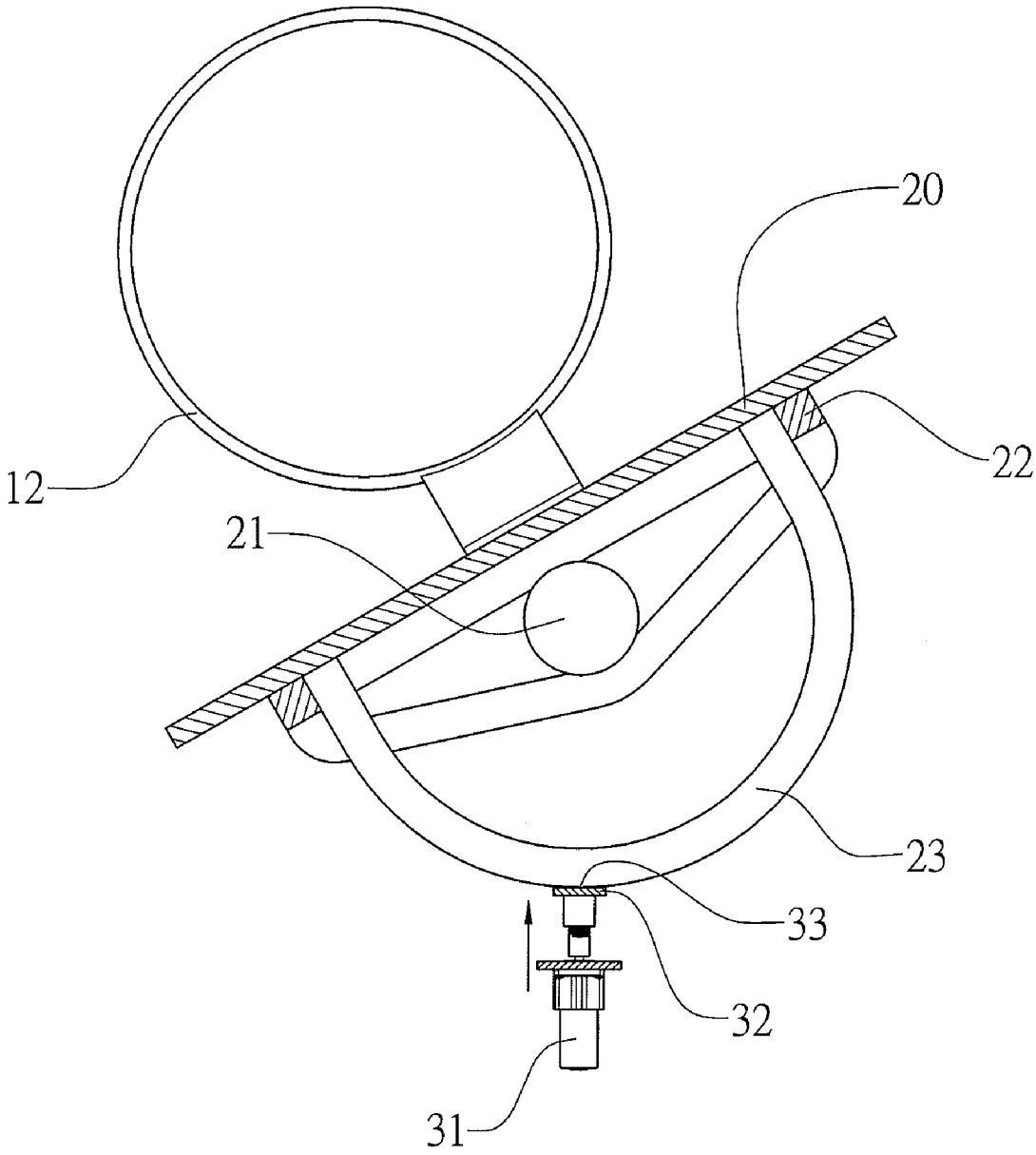
FIG. 6 is a partially enlarged top cross-sectional operational view of the basketball practicing apparatus as shown in FIG. 1.

In operation, referring to FIGS. 4-6 with reference to FIGS. 1-3, when the drive shaft 21 is rotated by operation of the drive unit 24, the backboard 20 is rotated by the drive shaft 21, and the basket ring 12 is moved by the backboard 20, so that the basket ring 12 is rotated about the drive shaft 21 as shown in FIGS. 4 and 5 to change the position and angle of the basket ring 12. After the position of the basket ring 12 is adjusted and fixed, the fixing member 32 is moved toward the positioning bar 23 by operation of the actuating unit 31 to press the positioning bar 23 as shown in FIG. 6 so as to position the positioning bar 23 and to lock the backboard 20 and the basket ring 12. Thus, the backboard 20 and the basket ring 12 are positioned solidly and stably by the fixing member 32 to prevent the backboard 20 and the basket ring 12 from being deflected due to a violent hitting force applied on the backboard 20 and the basket ring 12.

In the preferred embodiment of the present invention, each of the drive unit 24 and the actuating unit 31 consists of gears, belts, chains and the like.

Accordingly, the backboard 20 and the basket ring 12 are rotated about the drive shaft 21 so that the position and angle of the backboard 20 and the basket ring 12 can be changed arbitrarily and freely to facilitate a user practicing throwing the basketballs in different angles. In addition, the backboard 20 and the basket ring 12 are positioned solidly and stably by the fixing member 32 to prevent the backboard 20 and the basket ring 12 from being deflected due to a violent hitting force applied by the basketballs.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A basketball practicing apparatus, comprising:

a frame;

a support bracket mounted in the frame;

a drive shaft rotatably mounted on the support bracket;

a backboard mounted on the drive shaft to rotate in concert with the drive shaft;

a basket ring mounted on the backboard to move in concert with the backboard wherein said apparatus has a positioning bar mounted on the backboard to move in concert with the backboard, a fixing member movably mounted on the support bracket and movable to press the positioning bar so as to position the positioning bar and having an actuating unit mounted on the support bracket and connected with the fixing member to drive the fixing member to move relative to the positioning bar.

2. The basketball practicing apparatus of claim 1, further comprising:

a reinforcement rib mounted on the backboard to reinforce a strength of the backboard.

3. The basketball practicing apparatus of claim 1, further comprising:

a drive unit connected with the drive shaft to rotate the drive shaft.

4. The basketball practicing apparatus of claim 3, wherein the drive shaft has an upper end rotatably mounted on the support bracket and a lower end connected with the drive unit.

5. The basketball practicing apparatus of claim 3, wherein the drive unit includes a plurality of gears intermeshing with each other.

6. The basketball practicing apparatus of claim 2, wherein the reinforcement rib is located between the backboard and the drive shaft.

7. The basketball practicing apparatus of claim 6, wherein the backboard is located between the basket ring and the drive shaft.

8. The basketball practicing apparatus of claim 1, wherein the fixing member has a substantially U-shaped profile.

9. The basketball practicing apparatus of claim 8, wherein the fixing member has an opening that is movable to receive the positioning bar.

10. The basketball practicing apparatus of claim 9, wherein the opening of the fixing member is directed toward the positioning bar.

11. The basketball practicing apparatus of claim 1, wherein the positioning bar has a substantially arc-shaped profile.

12. The basketball practicing apparatus of claim 1, wherein the drive shaft is disposed at an upright state.

13. The basketball practicing apparatus of claim 1, wherein the drive shaft functions as a fulcrum of rotation of the backboard and the basket ring.

14. The basketball practicing apparatus of claim 1, further comprising:

a return table mounted in the frame and located under the basket ring to return basketballs falling from the basket ring.

* * * * *